US007325408B2

(12) United States Patent
Lim

(10) Patent No.: US 7,325,408 B2
(45) Date of Patent: Feb. 5, 2008

(54) METHOD OF CONTROLLING A REFRIGERATOR

(75) Inventor: Seung Tae Lim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 298 days.

(21) Appl. No.: 11/186,749

(22) Filed: Jul. 22, 2005

(65) Prior Publication Data

US 2006/0064994 A1 Mar. 30, 2006

(30) Foreign Application Priority Data

Sep. 30, 2004 (KR) ..... 10-2004-0078102

(51) Int. Cl.
*F25C 1/12* (2006.01)

(52) U.S. Cl. ..... 62/66; 62/344; 141/198

(58) Field of Classification Search ..... 62/66, 62/344, 340–356; 141/94, 198; 222/146.6
See application file for complete search history.

(56) References Cited

U.S. PATENT DOCUMENTS 4,961,456 A * 10/1990 Stembridge et al. ..... 141/1
5,219,008 A * 6/1993 Shannon ..... 141/83
5,269,154 A * 12/1993 Schmidt ..... 62/275
5,323,691 A * 6/1994 Reese et al. ..... 99/275
5,566,732 A * 10/1996 Nelson ..... 141/94
5,619,901 A * 4/1997 Reese et al. ..... 99/275
6,135,173 A * 10/2000 Lee et al. ..... 141/361
6,705,356 B2 * 3/2004 Barton et al. ..... 141/2

FOREIGN PATENT DOCUMENTS

KR 10-285847 1/2001
KR 2001-26389 4/2001

* cited by examiner

*Primary Examiner*—William E. Tapolcai
(74) *Attorney, Agent, or Firm*—Staas & Halsey LLP

(57) ABSTRACT

A method of controlling a refrigerator having a shaved ice discharger to discharge shaved ice produced within the refrigerator to the outside. The refrigerator includes a shaved-ice maker equipped within a freezing compartment to produce shaved ice, a shaved ice discharge port to discharge the shaved ice produced by the shaved-ice maker to the outside through the freezing compartment door, and a shaved ice discharger connected with the shaved ice discharge port to discharge the shaved ice produced by the shaved-ice maker to the outside of the refrigerator. Since the refrigerator is controlled to maintain the open state of the shaved ice discharge port during a predetermined shaved ice discharging time set corresponding to a selected amount of the shaved ice, it is not necessary to continuously apply external force to the lever, thereby improving convenience in use of the shaved-ice maker.

9 Claims, 5 Drawing Sheets

METHOD OF CONTROLLING A REFRIGERATOR

CROSS-REFERENCE TO RELATED APPLICATIONS

This application claims the benefit of Korean Patent Application No. 2004-78102, filed on Sep. 30, 2004 in the Korean Intellectual Property Office, the disclosure of which is incorporated herein by reference.

BACKGROUND OF THE INVENTION

1. Field of the Invention

The present invention relates to a refrigerator, and, more particularly, to a method of controlling a refrigerator, which has a shaved ice discharger to discharge shaved ice produced within the refrigerator to an outside of the refrigerator.

2. Description of the Related Art

Generally, a refrigerator generates cold air through a cooling cycle within the refrigerator, so that various foods can be stored in a refrigerated state or a frozen state by means of the cold air therein. In particular, a large refrigerator is equipped with an automatic icemaker to automatically produce ice cubes.

Recently, in order to prepare shaved ice or iced beverages using shaved ice, a refrigerator has been developed which includes a shaved-ice maker to produce the shaved ice by pulverizing the ice cubes supplied from the automatic icemaker, and a shaved ice discharger to discharge the shaved ice produced in the shaved-ice maker to the outside of the refrigerator, so that the shaved ice produced in the refrigerator through the shaved-ice maker can be supplied to the outside thereof.

The shaved ice discharger includes a damper to open and close a shaved ice discharge port provided to a freezing compartment door, and a lever hinged to the lower end of the shaved ice discharge port such that the lever is rotated and operates the damper upon application of an external force to open the shaved ice discharge port.

However, since such a conventional refrigerator requires a considerable time for producing the shaved ice by pulverizing the shaved ice through the shaved-ice maker, there is an inconvenience in that a user of the refrigerator must continuously press the lever for a long time.

SUMMARY OF THE INVENTION

Accordingly, it is an aspect of the present invention is to provide a method of controlling a refrigerator, which can keep a shaved ice discharge port open for a predetermined time.

Additional aspects and/or advantages of the invention will be set forth in part in the description which follows and, in part, will be apparent from the description, or may be learned by practice of the invention.

These and/or other aspects of the present invention are achieved by providing a method of controlling a refrigerator having a body having a freezing compartment defined therein, a freezing compartment door to open and close the freezing compartment, a shaved-ice maker equipped within the freezing compartment to produce shaved ice, a shaved ice discharge port to discharge the shaved ice produced by the shaved-ice maker to an outside through the freezing compartment door, and a shaved ice discharger connected with the shaved ice discharge port to open the shaved ice discharge, the method including selecting a desired amount of the shaved ice to be discharged from the shaved ice discharger, and opening the shaved ice discharge port for a predetermined shaved ice discharging time set corresponding to the selected amount of the shaved ice.

The opening of the shaved ice discharge port for the predetermined shaved ice discharging time includes confirming the selected amount of the shaved ice to be discharged, opening the shaved ice discharge port, determining whether the predetermined shaved ice discharging time set corresponding to the selected amount of the shaved ice elapses, and closing the shaved ice discharge port when the predetermined shaved ice discharging time elapses.

During the opening of the shaved ice discharge port, the shaved-ice maker may produce the shaved ice.

The shaved ice discharger includes a damper hinged to one side of the shaved ice discharge port to open and close the shaved ice discharge port, and a lever disposed below the shaved ice discharge port such that a lower end of the lever is pressed backward upon application of external force, thereby hinging the damper to open the shaved ice discharge port.

The method further includes detecting whether an external force is applied to the lever before the shaved ice discharge port is opened.

The method further includes maintaining the lower end of the lever in a state of being pressed backward while opening the shaved ice discharge port.

The freezing compartment door includes a sensor to detect whether a container to contain the shaved ice discharged from the shaved ice discharger is present below the shaved ice discharger.

The method further includes detecting whether the container is present below the shaved ice discharger through the sensor, and returning the lever to its original position when the container is not present below the shaved ice discharger, after maintaining the lower end of the lever in the state of being pressed backward.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION OF THE PREFERRED EMBODIMENTS

Figure 1:
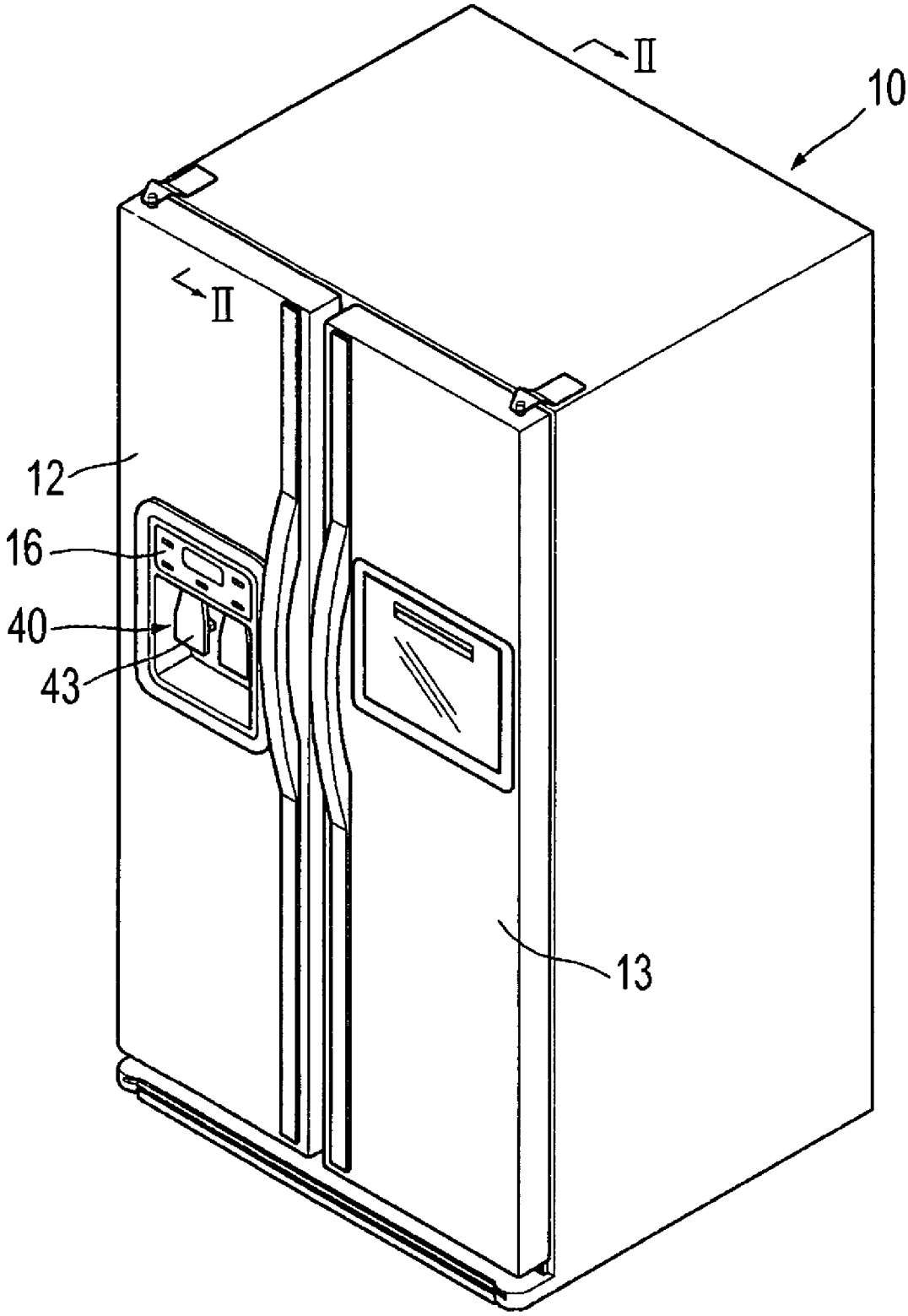
FIG. 1 is a perspective view illustrating a refrigerator having a method of controlling the refrigerator in accordance with an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 2:
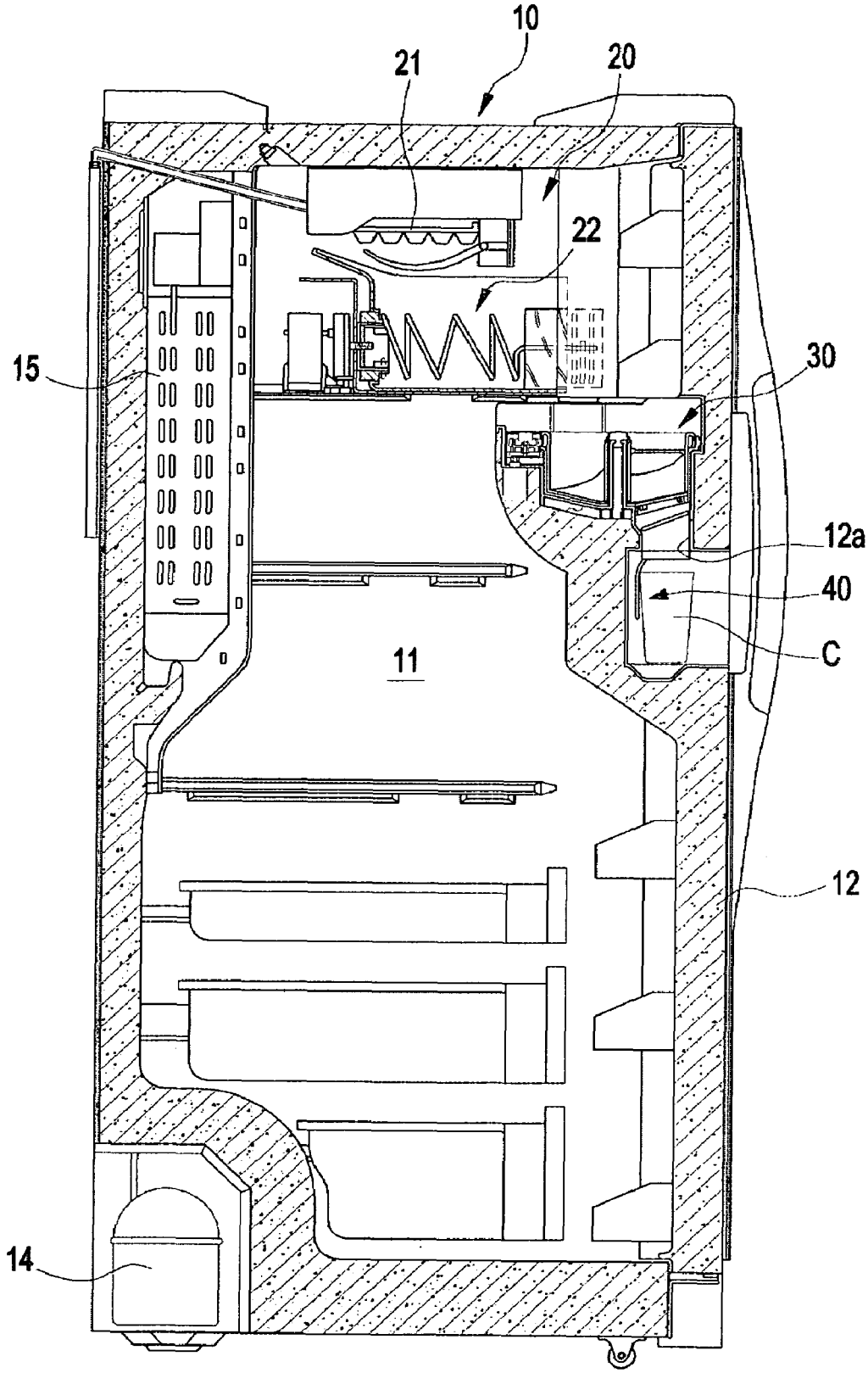
FIG. 2 is a cross-sectional view illustrating the refrigerator shown in FIG. 1.

In FIGS. 1 and 2, a refrigerator having a method of controlling the refrigerator in accordance with an embodiment of the present invention, the refrigerator comprises a body 10 opened at the front side thereof and having an inner portion partitioned into a freezing compartment 11 and a refrigerating compartment (not shown). The freezing compartment 11 and the refrigerating compartment are opened and closed by a freezing compartment door 12 and a refrigerating compartment door 13 hinged to the front side of the body, respectively.

The refrigerator comprises a compressor 14 at a rear lower portion of the body 10 to compress a refrigerant, an evaporator 15 on a rear wall of the body 10 to generate cold air, and an automatic icemaker 20 within the freezing compartment 11 to automatically produce and supply ice cubes having a predetermined size after receiving the cold air produced from the evaporator 15.

The automatic icemaker 20 comprises an ice tray 21, to freeze water supplied thereto, thus forming ice cubes, an ice cube container 22 disposed below the ice tray 21 to contain the ice cubes formed in the ice tray 11, and an ice cube conveyer 23 disposed in the ice container 22 to convey the ice cubes to the freezing compartment door 12, and the like.

The freezing compartment door 12 comprises a shaved-ice maker 30, which produces shaved ice using the ice cubes supplied from the ice cube container 22, and a shaved ice discharge port 12*a,* which discharges the shaved ice produced by the shaved-ice maker 30 to the outside through the freezing compartment door 12.

The shaved ice discharge port 12*a* is provided with a shaved ice discharger 40 to discharge the shaved ice produced by the shaved-ice maker 30 to the outside. The freezing compartment door 12 has a control panel 16 equipped on the front side thereof and incorporating a microcomputer to allow a user to select functions of the shaved ice discharger 40.

Figure 3:
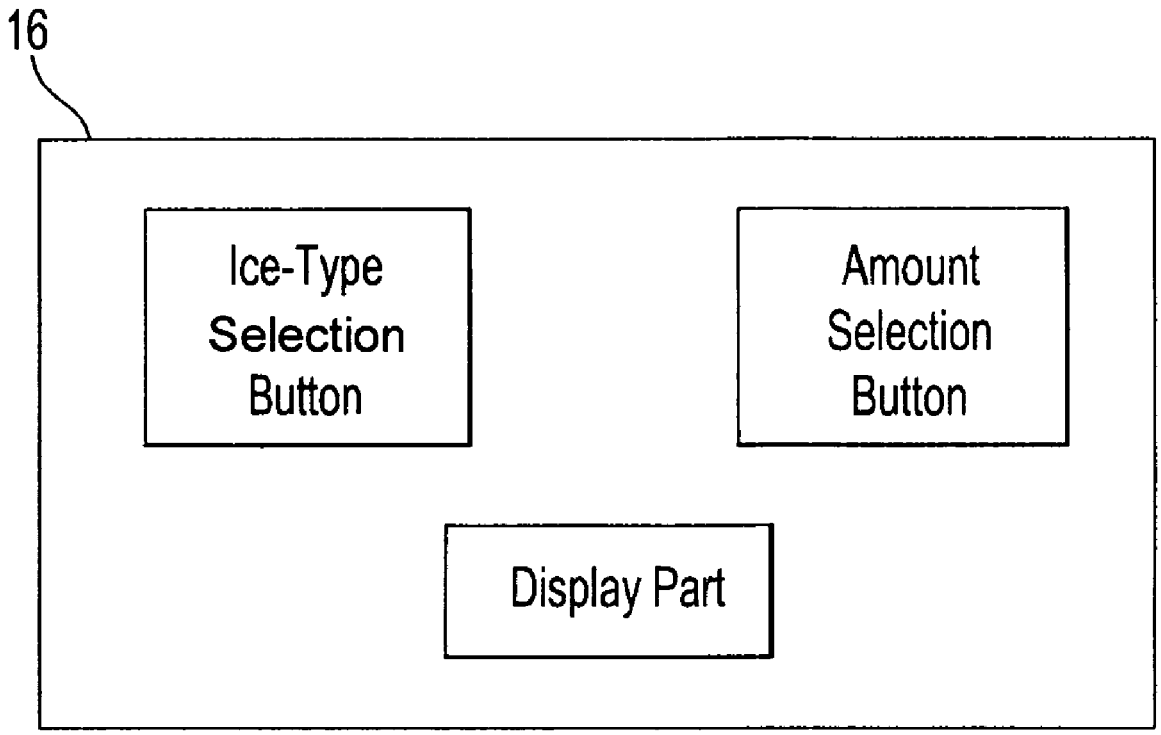
FIG. 3 is a block diagram illustrating a control panel of the refrigerator shown in FIGS. 1 and 2.

Referring to FIG. 3, the control panel 16 comprises operating buttons, such as an ice-type selection button 16*a* to select shaved ice or ice cubes, an amount selection button 16*b* via which the desired amount of shaved ice is input, and a display part 16*c* to display the type and amount of ice selected thereon.

Figure 4:
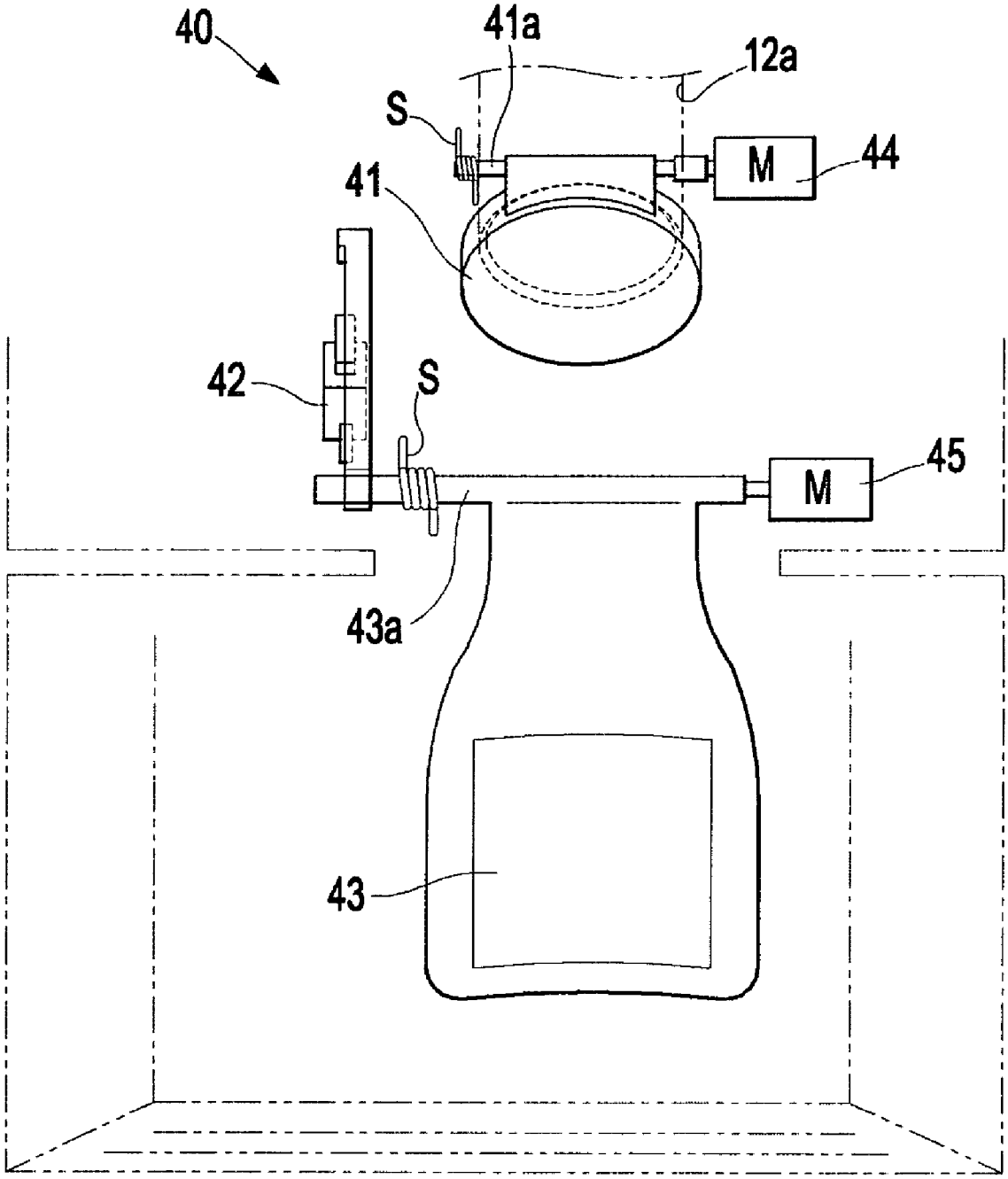
FIG. 4 is a view illustrating a shaved ice discharger of the refrigerator shown in FIGS. 1 and 2.

Referring to FIG. 4, the shaved ice discharger 40 comprises a damper 41 hinged to one side of the shaved ice discharge port 12*a,* and rotated by a first driving device 44 generating power to open and close the shaved ice discharge port 12*a,* a switch 42 to apply electric power to the first driving device 44 when depressed, and a lever 43 hinged to the lower end of the shaved ice discharge port 12*a* and rotated upon application of external force to compress the switch 42. The lever 43 is provided with a second driving device 45 generating power, so that, even when the external force is not applied to the lever 43, the lower end of the lever can be maintained in a state of being pressed backward by virtue of the power generated by the second driving device 45. The first and second driving devices 44 and 45 (i.e., driving motors) generate a rotational force.

Here, the damper 41 and the lever 43 are hinged to one side of the shaved ice discharge port 12*a* and the lower end of the shaved ice discharge port 12*a* by means of a damper hinge shaft 41*a* and a lever hinge shaft 43*a,* respectively, both of which are equipped with torsion springs S, so that the damper 41 is maintained in a state of closing the shaved ice discharge port 12*a* by virtue of an elastic force of the torsion spring S, and so that the lower end of the lever 43 is maintained in a state of being elastically supported by virtue of an elastic force of the torsion spring S.

Furthermore, the freezing compartment door 12 is equipped with a sensor 46 to detect whether or not a container C to contain the shaved ice discharged from the shaved ice discharge port 12*a* is located below the shaved ice discharge port 12*a*.

Figure 5:
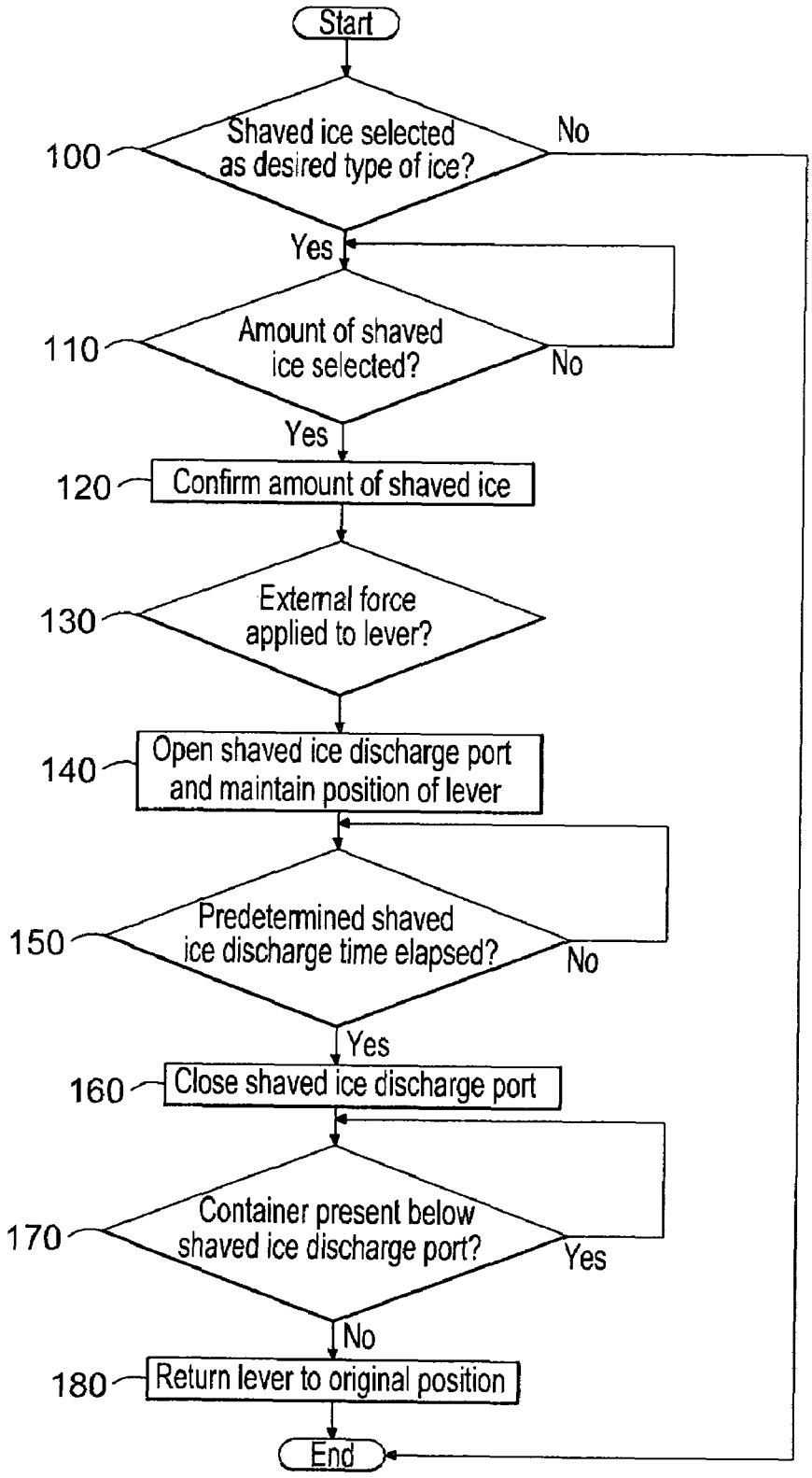
FIG. 5 is a flowchart illustrating a method of controlling the refrigerator in accordance with an embodiment of the present invention.

A method of controlling a refrigerator in accordance with an embodiment of the present invention will now be described with reference to FIG. 5.

In operation 100, it is determined whether shaved ice is selected as the desired type of ice between ice cubes and shaved ice.

From operation 100, the process moves to operation 110, where determining whether an amount of the shaved ice is selected when the shaved ice is selected as the desired type of ice.

From operation 110, the process moves to operation 120, where the amount of the shaved ice selected in operation 110 is confirmed.

From operation 120, the process moves to operation 130, where it is determined whether an external force is applied to a lever 43. When it is determined in operation 130, that an external force is applied to the lever 43, the process moves to operation 140, where the a shaved ice discharge port 12*a* is opened.

From operation 140, the process moves to operation 150, where it is determined whether a predetermined shaved ice discharging time set corresponding to the selected amount of the shaved ice has elapsed since the shaved ice discharge port 12*a* was opened.

From operation 150, the process moves to operation 160 where the shaved ice discharge port is closed when the predetermined shaved ice discharging time elapses.

Further, in operation 100, where it is determined whether the shaved ice is selected as the desired type of ice between ice cubes and shaved ice, the user's selection is made through an ice-type selection button 16*a* on a control panel 16, and when the shaved ice is selected as the desired type of ice, the process moves to operation 110, where it is determined whether the amount of the shaved ice is selected by the user through an amount selection button 16*b* on the control panel 16.

When the amount of the shaved ice, such as one serving or two servings, is input through the amount selection button 16*b* in operation 110, the process moves to operation 120, where the selected amount of the shaved ice is confirmed.

From operation 120, the process moves to operation 130, where it is determined whether an external force has been applied to the lever 43. When it is determined that an external force has been applied to the lever 43 in operation 130, the process moves to operation 140, where the shaved ice discharge port 12*a* is opened by operating the damper 41 in a state of closing the shaved ice discharge port 12*a* through application of electric power to a first driving device 44.

In the present embodiment, since the first driving device 44, a driving motor, is connected with a damper hinge shaft 41*a,* the shaved ice discharge port 12*a* is opened as the damper 41 rotates. When the shaved ice discharge port 12*a* is opened, a shaved-ice maker 30 is activated and begins producing shaved ice.

Subsequently, when the shaved ice discharge port 12*a* is opened, the duration for which the shaved ice discharge port 12*a* is kept open is checked by means of the microcomputer incorporated in the refrigerator, and in operation 150, it is determined whether a predetermined shaved ice discharging time set corresponding to the selected amount of the shaved ice has elapsed since the shaved ice discharge port 12*a* was opened, and when it is determined that the predetermined shaved ice discharging time elapses, the electric power is cut off from the first driving device 44. Accordingly, the damper is rotated by the elastic force of a torsion spring equipped to the damper hinge shaft, and returns to its original position, thereby closing the shaved ice discharge port 12*a* in operation 160. When the shaved ice discharge port 12*a* is closed in operation 160, the shaved-ice maker 30 is deactivated, thus halting production of shaved ice.

With the refrigerator of the present invention, the method of controlling the refrigerator further comprises maintaining the lower end of the lever 43 in a state of being pressed backward while opening the shaved ice discharge port 12*a* in operation 140. Moreover, the method further comprises in operation 170, detecting whether a container C to contain the shaved ice therein, is present below the shaved ice discharge port 12*a* by means of a sensor 46, after closing the shaved ice discharge port 12*a* in operation 160, and in operation 180, returning the lever 43 to its original position when the container C is not located below the shaved ice discharger, which are successively executed.

As a result, the lever 43 maintains the state of being pressed backward without returning to it original position not only while the shaved ice is discharged through the shaved ice discharge port 12*a,* but also until the container C is removed from a lower portion of the shaved ice discharge port 12*a* after the shaved ice discharging time elapses, so that the lever 43 does not return to its original position when the container C remains below the shaved ice discharge port 12*a,* thereby preventing the lower end of the lever 43 from pushing the container C while moving in front of the refrigerator.

As is apparent from the above description, since the refrigerator according to the present invention is controlled to maintain the open state of the shaved ice discharge port during the predetermined shaved ice discharging time set corresponding to the selected amount of the shaved ice, it is not necessary to continuously apply the external force to the lever, thereby improving convenience in use of the shaved-ice maker.

Although the preferred embodiments of the invention have been disclosed for illustrative purposes, those skilled in the art will appreciate that various modifications, additions and substitutions are possible, without departing from the principles and spirit of the invention, the scope of which is defined in the claims and their equivalents.

What is claimed is:

1. A method of controlling a refrigerator having a body having a freezing compartment defined therein, a freezing compartment door to open and close the freezing compartment, a shaved-ice maker equipped within the freezing compartment to produce shaved ice, a shaved ice discharge port to discharge the shaved ice produced by the shaved-ice maker to the outside through the freezing compartment door, and a shaved ice discharger connected with the shaved ice discharge port to open the shaved ice discharge port, the method comprising;

selecting a desired amount of the shaved ice to be discharged from the shaved ice discharger;

opening the shaved ice discharge port for a predetermined shaved ice discharging time set corresponding to the selected amount of the shaved ice; and detecting whether or not the container is present below the shaved ice discharger.

2. The method according to claim 1, wherein the opening of the shaved ice discharge port for the predetermined shaved ice discharging time comprises:

confirming the selected amount of the shaved ice to be discharged;

opening the shaved ice discharge port;

determining whether the predetermined shaved ice discharging time set corresponding to the selected amount of the shaved ice elapses; and closing the shaved ice discharge port when the predetermined shaved ice discharging time elapses.

3. The method according to claim 1, wherein during the opening of the shaved ice discharge port, the shaved-ice maker produces the shaved ice.

4. The method according to claim 2, wherein the shaved ice discharger comprises a damper hinged to one side of the shaved ice discharge port to open and close the shaved ice discharge port, and a lever disposed below the shaved ice discharge port such that a lower end of the lever is pressed backward upon application of an external force, thereby hinging the damper to open the shaved ice discharge port, and the method further comprises detecting whether the external force is applied to the lever before the shaved ice discharge port is opened.

5. The method according to claim 4, further comprising maintaining the lower end of the lever in a state of being pressed backward while opening the shaved ice discharge port.

6. The method according to claim 5, wherein the freezing compartment door comprises a sensor to detect whether a container to contain the shaved ice discharged from the shaved ice discharger is present below the shaved ice discharger, and the method further comprises returning the lever to its original position when the container is not present below the shaved ice discharger through the sensor, after maintaining the lower end of the lever in the state of being pressed backward.

7. A method of controlling a refrigerator having a shaved ice discharger, the method comprising:

selecting a desired amount of shaved ice to be discharged from the shaved ice discharger;

discharging shaved ice from the shaved ice discharger for a predetermined time period set, corresponding to the selected amount of shaved ice; and detecting whether or not the container is present below the shaved ice discharger.

8. The method of claim 7, wherein the selecting the desired amount of shaved ice to be discharged comprises:

confirming the selected amount of shaved ice; and determining whether an external force is applied to a lever of the shaved ice discharger.

9. The method of claim 8, wherein the discharging of the shaved ice from the discharger comprises:

opening a port of the shaved ice discharger to discharge the shaved ice from the shaved ice discharger, and maintaining a position of the lever;

determining whether the predetermined time period elapses;

closing the port of the shaved ice discharger when the predetermined time period elapses;

detecting whether a container is present below the port, to receive the shaved ice therein; and returning the lever to an original position thereof, when it is determined that the container is not present below the port.

* * * * *